US005115910A

United States Patent [19]

Klygis et al.

[11] Patent Number: 5,115,910

[45] Date of Patent: May 26, 1992

[54] CARRIER STOCK WITH TEAR-OPEN BAND SEGMENTS

[75] Inventors: Mindaugas J. Klygis, Barrington; Leslie S. Marco, Bloomingdale, both of Ill.

[73] Assignee: Illinois Tool Works Inc., Glenview, Ill.

[21] Appl. No.: 699,004

[22] Filed: May 13, 1991

Related U.S. Application Data

[63] Continuation-in-part of Ser. No. 679,520, Apr. 2, 1991, which is a continuation-in-part of Ser. No. 537,674, Jun. 14, 1990, Pat. No. 5,020,661.

[51] Int. Cl.[5] ..... B65D 71/00

[52] U.S. Cl. ..... 206/150.0; 294/87.2

[58] Field of Search ..... 206/150, 151, 158, 160, 206/620, 628; 294/87.2

[56] References Cited

U.S. PATENT DOCUMENTS

| | | | |
|---|---|---|---|
| 2,997,169 | 4/1961 | Poupitch | 206/65 |
| 3,038,602 | 6/1962 | Rapata | 206/65 |
| 3,084,792 | 4/1963 | Poupitch | 206/56 |
| 3,086,651 | 4/1963 | Poupitch | 206/65 |
| 3,504,790 | 4/1970 | Owen | 206/65 |
| 3,721,337 | 3/1973 | Braun et al. | 206/65 E |
| 3,830,361 | 8/1974 | Klygis | 206/150 |
| 4,018,331 | 4/1977 | Klygis | 206/199 |
| 4,019,787 | 8/1978 | Klygis et al. | 206/150 |
| 4,064,989 | 12/1977 | Olsen | 206/428 |
| 4,219,117 | 8/1980 | Weaver | 206/150 |
| 4,462,494 | 7/1984 | Cunningham | 206/150 |
| 4,548,317 | 10/1985 | Weaver | 206/150 |
| 4,925,020 | 5/1990 | Gordon | 206/150 |
| 5,038,928 | 8/1991 | Marco et al. | 206/150 |
| 5,108,620 | 5/1991 | Marco et al. | 206/150 |

*Primary Examiner*—Jimmy G. Foster

*Attorney, Agent, or Firm*—Dressler, Goldsmith, Shore, Sutker & Milnamow

[57] ABSTRACT

Carrier stock for machine application to substantially identical containers, such as beverage cans, has tear-open capability provided by tear-open band segments. Such segments, which extend between adjacent containers, are divided into half segments and have slits and frangible bridge, whereby a tear beginning at a crotch at one end can propagate through such a half segment. The slits include slits common to the half segments and slits staggered transversely.

15 Claims, 3 Drawing Sheets

CARRIER STOCK WITH TEAR-OPEN BAND SEGMENTS

CROSS-REFERENCES TO RELATED APPLICATIONS

This application is a continuation-in-part of U.S. patent application Ser. No. 07/679,520 filed Apr. 2, 1991, and assigned commonly herewith for "Carrier Stock with Tear-Open Tabs", which is a continuation-in-part of U.S. patent application Ser. No. 07/537,674 filed June 14, 1990, now U.S. Pat. No. 5,020,662, and assigned commonly herewith, for "Carrier Stock With Tear-Open Tabs". The disclosures of both of these applications are incorporated herein by reference.

TECHNICAL FIELD OF THE INVENTION

This invention pertains to carrier stock for machine application to substantially identical containers. This invention pertains, more particularly, to carrier stock that is severable to form individual carriers with separate apertures to receive the individual containers. The carrier stock has tear-open capability, which does not rely upon tear-open tabs, but which relies upon tear-open band segments.

BACKGROUND OF THE INVENTION

Typically, carrier stock with individual container-receiving apertures for machine application to substantially identical containers is formed, as by die-cutting, from a single sheet of resilient polymeric material.

Various attempts have been made to provide such carrier stock with tear-open capability. An example is disclosed in Olsen U.S. Pat. No. 4,064,989. As disclosed therein, outer band segments of such carrier stock are formed with tear-open tabs.

In each of the related applications referenced above, improved carrier stock with tear-open capability provided by tear-open tabs having improved features is disclosed. Such tear-open tabs offer significant advantages over tear-open tabs known previously.

In some instances, however, consumer preferences, characteristics of application machines, regulatory considerations, or other factors may dissuade packagers of beverage cans or other containers from using carrier stock having tear-open tabs. Thus, there has been a need, to which this invention is addressed, for carrier stock having tear-open capability that does not rely upon tear-open tabs.

SUMMARY OF THE INVENTION

This invention provides improved carrier stock for machine application to substantially identical containers. The carrier stock has tear-open capability, which does not rely upon tear-open tabs, but which relies upon tear-open band segments.

The carrier stock is formed from a single sheet of resilient polymeric material and is severable transversely to form individual carriers. Each carrier has band segments defining separate apertures in a rectangular array comprising longitudinal rows and transverse ranks to receive the individual containers. The band segments comprise outer segments extending in a generally longitudinal direction when the carrier stock is unstressed, inner segments extending in a generally longitudinal direction when the carrier stock is unstressed, and cross segments extending in a generally transverse direction when the carrier stock is unstressed. Each individual carrier has two opposite edges.

The band segments defining each container-receiving aperture of each carrier include at least one cross segment joined integrally to two outer segments so as to define a generally Y-shaped junction with a crotch narrowing toward a generally transverse midline of the cross segment so joined. The transverse midline divides the cross segment so joined into two half segments. The cross segment so joined has a primary slit extending substantially along the transverse midline and being spaced from the crotch by a frangible bridge formed of the sheet material. The cross segment so joined has at least one secondary slit, which may extend transversely along one of the half segments.

The secondary slit is spaced from the primary slit by another frangible bridge formed of the sheet material. The secondary slit is spaced from one of the container-receiving apertures by at least one frangible bridge formed of the sheet material.

Accordingly, a tear beginning at the crotch can propagate from the crotch to the primary slit, from the primary slit to the secondary slit, and from the secondary slit to one of the container-receiving apertures, so as to break the half segment having the secondary slit. When such half segment breaks, a container that had been received by the same one of the container-receiving apertures can be easily removed.

Preferably, the cross segment so joined has a series of secondary slits extending transversely. The series includes the secondary slit, which is spaced from the primary slit by a frangible bridge formed of the sheet material, and a different slit, which is spaced from such container-receiving aperture by such a frangible bridge. The series of secondary slits may include an inner slit and an outer slit with the inner slit being spaced from the outer slit by another frangible bridge formed of the sheet material. Preferably, moreover, the primary and secondary slits are staggered transversely.

In a preferred construction, the cross segment so joined separates two container-receiving apertures. Moreover, the cross segment so joined is divided by the transverse midline into a first half segment at one such aperture and a second half segment at the other aperture. Furthermore, each of the first and second half segments has similar slits and frangible bridges.

Each of the first and second half segments may have a similar series of secondary slits extending transversely, as described above. Thus, each of the first and second half segments may have similar inner and outer slits and associated bridges, which may present a mirror image of the inner and outer slits and associated bridges described above.

These and other objects, features, and advantages of this invention are evident from the following description of a preferred embodiment of this invention with reference to the accompanying drawings.

DETAILED DESCRIPTION OF PREFERRED EMBODIMENT

Figure 2:
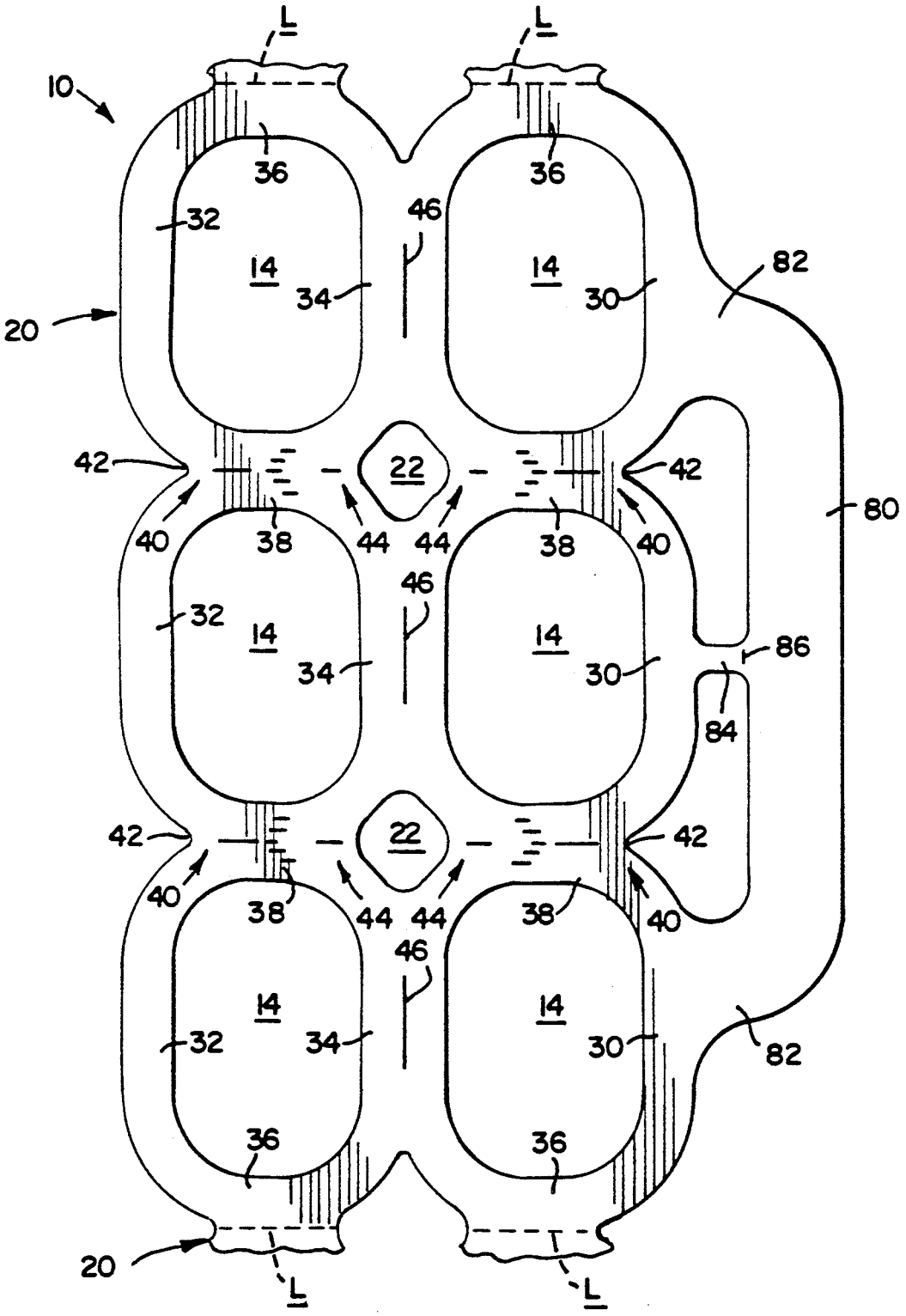
FIG. 2 is a plan view of carrier stock according to this invention.

As shown in the drawings, carrier stock 10 for machine application to substantially identical containers 12 constitutes a preferred embodiment of this invention. Such stock 10 is severable, along transverse lines L, to form individual carriers 20 that are substantially identical. As shown in FIG. 2, the transverse lines L may be perforated, so as to facilitate severing the stock 10 into such carriers 20.

Figure 1:
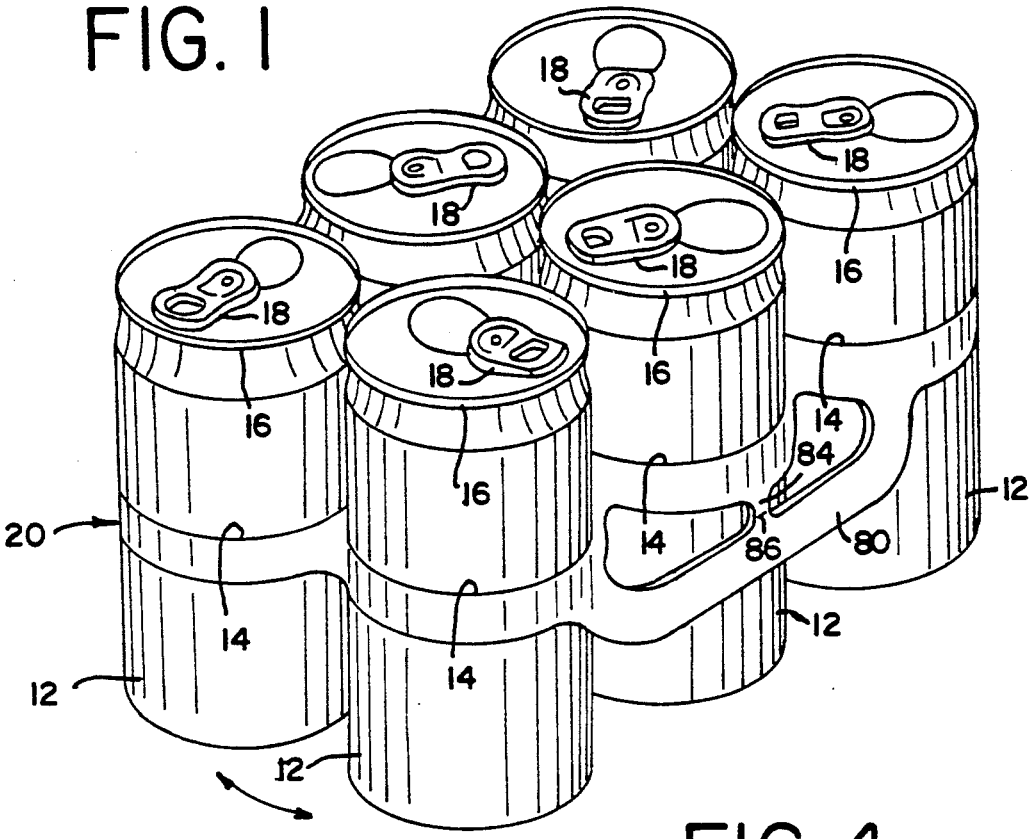
FIG. 1 is a perspective view of a package comprising six substantially identical containers and a carrier, which has a handle, and which is severed from carrier stock according to this invention.

As shown in FIG. 1, the containers 12 are beverage cans of a type used commonly for beer, soft drinks, and other beverages. Also, each container 12 has a chime 16 at one end, which is provided with a pull tab 18. This invention is not limited, however, to usage with such cans but is useful with cans, bottles, and other containers of various types.

In FIG. 1, a package is shown, which comprises six such containers 12 and one such carrier 20, as severed from such stock 10. One such carrier 20 is shown fully in FIG. 2, which also shows fragmentary portions of the next carriers 20, at opposite ends of the fully shown carrier 20.

The carrier stock 10 is formed in an indeterminate length, as by die-cutting, from a single sheet of resilient polymeric material. A preferred material is low density polyethylene. A preferred thickness for such stock 10 in an unstressed condition, if low density polyethylene is used, is about 14 mils.

The carrier stock 10 is formed, for each individual carrier 20, with integrally joined band segments defining six separate, substantially rectangular, container-receiving apertures 14, along with two smaller apertures 22. As shown in FIG. 2, the container-receiving apertures 14 are in a rectangular array with longitudinal rows and transverse ranks, namely two longitudinal rows and three transverse ranks for each carrier 20. Each of the smaller apertures 22 is disposed amid four container-receiving apertures 14.

Preferably, as shown in FIG. 1, the carrier stock 10 is applied to the side walls of the respective containers 12, away from the chime 16 of each container 12, between the upper and lower ends. Accordingly, it is possible to manipulate two adjacent containers 12 by separating their lower ends manually (as indicated by a curved arrow in FIG. 1) while using their upper ends as a fulcrum where their upper ends abut near their chimes 16, so as to stress the carrier 20 at the band segments between the adjacent containers 12.

As shown in FIG. 2, the band segments for each carrier 20 comprise three outer segments 30 at a handle edge of such carrier 20, three outer segments 32 at an opposite edge of such carrier 20, three inner segments 34 between the outer segments 30 and the outer segments 32, two cross segments 36 at each of the opposite ends of such carrier 20, and two cross segments 38 in each of two transverse regions between the cross segments 36 at such ends. The outer segments 30, 32, at the respective edges of such carrier 20 and the inner segments 34 therebetween extend in a generally longitudinal direction when the carrier stock 10 is unstressed. The cross segments 36 at the opposite ends of such carrier 20 and the cross segments 38 located therebetween extend in a generally transverse direction when the carrier stock 10 is unstressed. The cross segments 36 at the carrier ends are bisected transversely by the transverse lines L, along which the carrier stock 10 is severable. Each inner segment 34 has a slit 46, which extends in a generally horizontal direction when the carrier stock 10 is unstressed, and which facilitates folding of such inner segment 34 when the carrier stock 10 is applied to the containers 12.

Figure 3:
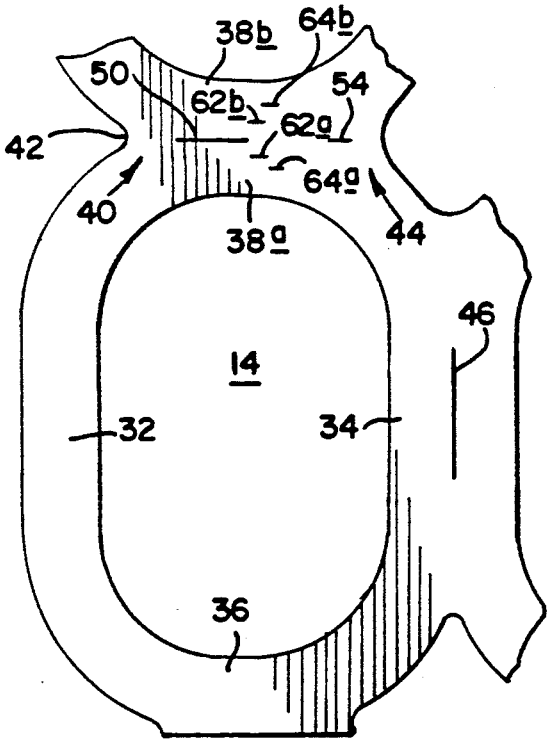
FIG. 3, on an enlarged scale, is a detail showing band segments defining one container-receiving aperture of such a carrier before one half segment is torn.

As shown in FIG. 3, each cross segment 38 is joined integrally at its outer end to two outer segments 30 so as to define a generally Y-shaped junction 40 with a crotch 42 narrowing generally toward a transverse midline of such cross segment 38. The transverse midline of each cross segment 38 divides such cross segment 38 into two half segments, namely a first half segment **38*a* at one of the container-receiving apertures 14 and a second half segment 38*b* at another such aperture 14. At its inner end, each cross segment 38 is joined integrally to two outer segments 30 so as to define a generally Y-shaped junction 44 at one of the smaller apertures 22**.

Near its outer end, each cross segment 38 has a primary slit 50 extending substantially along the transverse midline of such cross segment 38 and being spaced from the crotch 42 of such cross segment 38 by a frangible bridge formed of the sheet material. Each of the first and second half segments **38*a*, 38*b*, of such cross segment 38 has a series of secondary slits extending transversely, namely an inner slit 62*a* and an outer slit 64*a* in the half segment 38*a* and an inner slit 62*b* and an outer slit 64*b* in the half segment 38*b*. Near its inner end, each cross segment 38 has a tertiary slit 54, which is aligned transversely with the inner slit 60 and with the primary slit 50. The tertiary slit 54, which is disposed between the inner slit 60 and the nearest aperture 22, serves to further weaken such cross segment 38**.

The inner slit **62*a* of the half segment 38*a* is spaced from the inner slit 60 by a frangible bridge formed of the sheet material. The inner slit 62*a* thereof is spaced from the outer slit 64*a* thereof by another frangible bridge formed of the sheet material. The inner slit 62*b* of the half segment 38*b* is spaced from the outer slit 64*b* thereof by another frangible bridge formed of the sheet material. The outer slit 64*a* of the half segment 38*a* is spaced from the nearer aperture 14 by another frangible bridge formed of the sheet material. The outer slit 64*b* of the half segment 38*b* is spaced from the nearer aperture 14 by another frangible bridge formed of the sheet material. As shown in FIG. 3, the primary slit 50, the inner slit 62*a* of the half segment 38*a*, and the outer slit 64*a* thereof are staggered transversely. Similarly, the primary slit 50, the inner slit 62*b* of the half segment 38*b*, and the outer slit 64*b*** thereof are staggered transversely.

Figure 4:
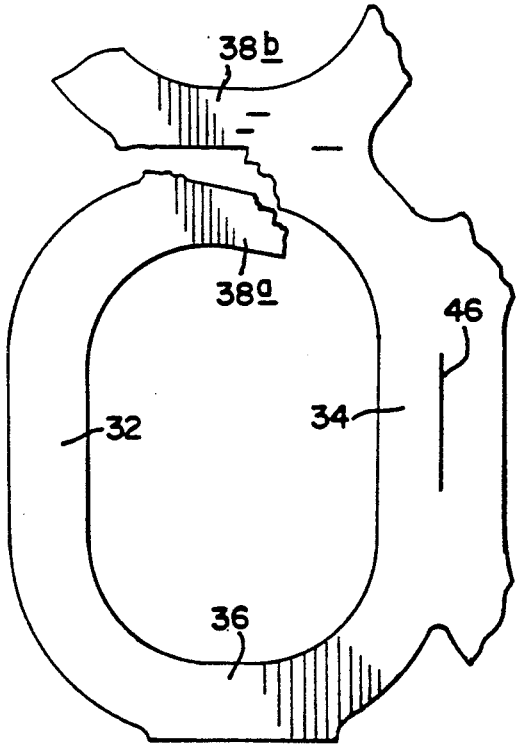
FIG. 4, on a similar scale, is a detail showing such segments after the half segment has been torn.

From a comparison of FIGS. 3 and 4, it is evident that a tear beginning at the crotch 46 can propagate so as to tear through one such half section to the aperture 14 bounded partly by the same half section. Thus, the tear can propagate from the primary slit 50, through the frangible bridge spacing the inner slit **62*a* of the half section 38*a* from the primary slit 50, to the inner slit 62*a* thereof, from the inner slit 62*a* thereof, through the frangible bridge spacing the outer slit 64*a* thereof from the inner slit 62*a* thereof, to the outer slit 64*a* thereof, and from the outer slit 64*a* thereof, through the frangible bridge spacing the nearest aperture 14 from the outer slit 64***a* thereof, to the nearest aperture 14. Alternatively, or additionally, the tear can propagate through the half section 38*b* in like manner.

As shown in FIGS. 1 and 2, the carrier stock 10 may be desirably provided, at each carrier 20, with an integral handle 80 having two end legs 82 and a middle leg 84. Each of the end legs 82 is joined integrally to one of the outer segments 30 defining one of the opposite ends of such carrier 20. The middle leg 84 is joined integrally with the outer segment 30 between the outer segments 30 defining the opposite ends of such carrier 20. Also, the middle leg 84 has a slit 86 weakening the middle leg 84, which tends to break at the slit 86 when a package comprising such carrier 20 is carried by the handle 80.

Figure 5:
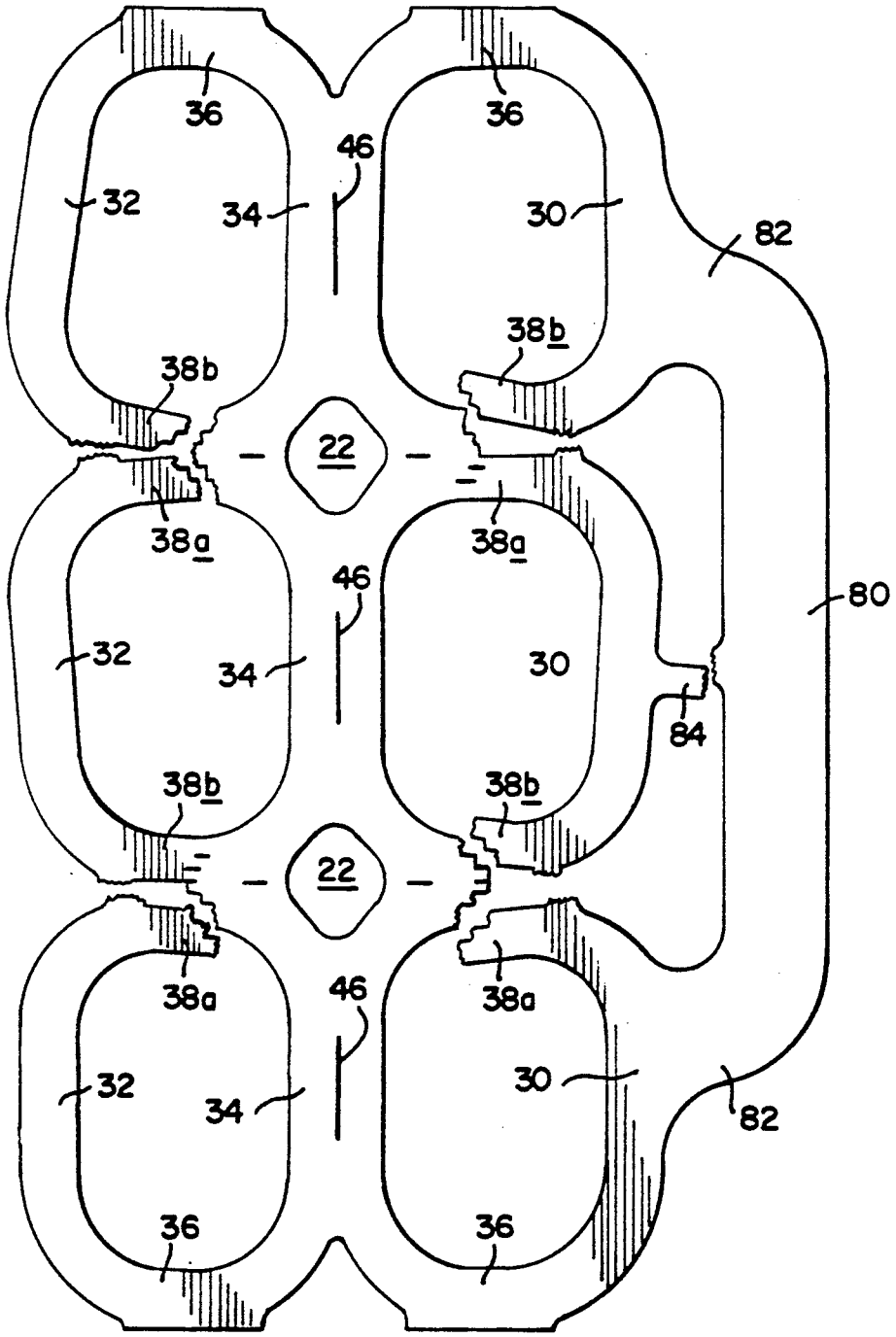
FIG. 5 is a plan view of the same carrier after various half segments have been torn.

Accordingly, as a user removes the containers 12 from a package comprising a carrier 20 severed from the carrier stock 10, at least one of the half segments 38*a*, 38*b*, of each slitted cross segment 38 of the carrier 20 tends to be completely torn from the crotch 46 of such slitted cross segment 38 to the nearest aperture 14. An exemplary pattern of torn half segments is shown in FIG. 5, in which such a carrier 20 is shown in a final condition wherein none of the container-receiving apertures 14 remains surrounded on all sides by unbroken band segments. Different patterns of torn half segments are possible, in which none of the container-receiving apertures 14 remains surrounded on all sides by unbroken band segments, or in which few of the container-receiving apertures 14 remain surrounded on all sides by unbroken band segments. The actual pattern of torn half segments depends upon vagaries of consumer usage.

In one alternative embodiment (not shown) contemplated by this invention, each individual carrier severable from the carrier stock has container-receiving apertures in three (or more) longitudinal rows. The carrier stock would be thus severable along band segments comparable to the band segments 32 of the carrier stock 10. Also, if a handle were provided in the alternative embodiment, the handle would be preferably attached at band segments comparable to the band segments 36.

In another alternative embodiment (not shown) each cross segment having primary and secondary slits, as described above, has its primary slit divided by a frangible bridge formed of the sheet material into a longer slit near the crotch defined where such cross segment joins two outer segments and a shorter slit near the tertiary slit of such cross segment.

Various other modifications may be made in the preferred embodiment described above without departing from the scope and spirit of this invention.

We claim:

1. Carrier stock for machine application to substantially identical containers, said stock being formed from a single sheet of resilient polymeric material and being severable transversely to form individual carriers, each carrier having band segments defining separate apertures in a rectangular array comprising longitudinal rows and transverse ranks to receive the individual containers, said segments comprising outer segments extending in a generally longitudinal direction when said stock is unstressed, inner segments extending in a generally longitudinal direction when said stock is unstressed, and cross segments extending in a generally transverse direction when said stock is unstressed, each individual carrier having two opposite edges, wherein the band segments defining each container-receiving aperture of each carrier include at least one cross segments joined integrally to two outer segments so as to define a generally Y-shaped junction with a crotch narrowing generally toward a transverse midline of the cross segment so joined, the transverse midline dividing the cross segment so joined into two half segments, the cross segment so joined having a primary slit extending substantially along the transverse midline and being spaced from the crotch by a primary, frangible bridge formed of the sheet material, the cross segment so joined having at least one secondary slit extending transversely, the primary and secondary slits having innermost extremities spaced longitudinally and transversely by a frangible bridge formed of the sheet material, the secondary slit being spaced from such container-receiving aperture by at least one frangible bridge formed of the sheet material, whereby a tear beginning at the crotch can propagate from the crotch to the primary slit, from the primary slit to the secondary slit, and from the secondary slit to such container-receiving aperture, so as to break the half segment having the secondary slit.

2. The carrier stock of claim 1 wherein the cross segment so jointed has a series of secondary slits, the series including an inner slit and an outer slit, the inner slit being spaced from the outer slit by another frangible bridge formed of the sheet material.

3. The carrier stock of claim 2 wherein the primary, inner, and outer slits are staggered transversely.

4. The carrier stock of claim 3 wherein the cross segment so joined has another slit aligned transversely with the primary and inner slits and spaced from the inner slit by another frangible bridge of the sheet material.

5. The carrier stock of claim 1 wherein each of the first and second half segments of the cross segment so joined separates two of the container-receiving apertures, wherein the cross segment so joined is divided by the transverse midline into a first half segment at one of the separated apertures and a second half segment at the other, and wherein each of the first and second half segments has such a secondary slit spaced from the midline thereof and has frangible bridges.

6. The carrier stock of claim 5 wherein each of the first and second half segments of the cross segment so joined has a similar series of secondary slits extending transversely and being spaced respectively from the midline thereof, the series including an inner slit spaced from the primary slit by a frangible bridge formed of the sheet material and an outer slit spaced from one of the container-receiving apertures by a frangible bridge formed of the sheet material, the inner slit being spaced from the outer slit by another frangible bridge formed of the sheet material.

7. The carrier stock of claim 6 wherein, in each of the first and second half segments of the cross segment so joined, the primary, inner, and outer slits are staggered transversely.

8. The carrier stock of claim 7 wherein the cross segment so joined has another slit aligned transversely with the primary and inner slits and spaced from each of the inner slits by another frangible bridge formed of the sheet material.

9. The carrier stock of claim 5 combined with substantially identical containers having upper and lower ends and having side walls, the carrier stock being applied to the containers, along the side walls, between the upper and lower ends in such manner that the cross segment having the primary and secondary slits is positioned between the side walls of two adjacent containers, whereby the cross segment having the primary and secondary slits tends to tear if the adjacent containers are manipulated by separating their lower ends while using their upper ends as a fulcrum.

10. The carrier stock of claim 5 wherein each of the first and second half segments of the cross segment so joined has a similar series of secondary slits spaced from the midline thereof, the series including an inner slit spaced from the primary slit by a frangible bridge formed of the sheet material and an outer slit spaced from one of the container-receiving apertures by a frangible bridge formed of the sheet material, the inner slit being spaced from the outer slit by another frangible bridge formed of the sheet material.

11. The carrier stock of claim 1 combined with substantially identical containers having upper and lower ends and having side walls, the carrier stock being applied to the containers, along the side walls, between the upper and lower ends in such manner that the cross segment having the primary and secondary slits is positioned between the side walls of two adjacent containers, whereby the cross segment having the primary and secondary slits tends to tear if the adjacent containers are manipulated by separating their lower ends while using their upper ends as a fulcrum.

12. Carrier stock for machine application to substantially identical containers, said stock being formed from a single sheet of resilient polymeric material and being severable transversely to form individual carriers, each carrier having band segments defining separate apertures in a rectangular array comprising longitudinal rows and transverse ranks to receive the individual containers, said segments comprising outer segments extending in a generally longitudinal direction when said stock is unstressed, inner segments extending in a generally longitudinal direction when said stock is unstressed, and cross segments extending in a generally transverse direction when said stock is unstressed, each individual carrier having two opposite edges, wherein the band segments defining each container-receiving aperture of each carrier includes at least one cross segment joined integrally to two outer segments so as to define a generally Y-shaped junction, the cross segment so joined having a transverse midline dividing the cross segment so joined into two half segments, the cross segment so joined having a primary slit extending substantially along the transverse midline and being spaced from an edge of the junction by a frangible bridge formed of the sheet material, the cross segment so joined having at least one secondary slit, the secondary slit being spaced longitudinally from the primary slit by a frangible bridge formed of the sheet material, the secondary slit being spaced longitudinally from such container-receiving aperture by at least one frangible bridge formed of the sheet material, wherein the primary and secondary slits and the frangible bridges are arranged wholly within the cross segment so joined to propagate a tear wholly within the cross segment so joined without propagating the tear into any of the outer and inner segments, from the junction to the primary slit, from the primary slit to the secondary slit, and from the secondary slit to such container-receiving aperture.

13. Carrier stock for machine application to substantially identical containers, said stock being formed from a single sheet of resilient polymeric material and being severable transversely to form individual carriers, each carrier having band segments defining separate apertures in a rectangular array comprising longitudinal rows and transverse ranks to receive the individual containers, said segments comprising outer segments extending in a generally longitudinal direction when said stock is unstressed, inner segments extending in a generally longitudinal direction when said stock is unstressed, and cross segments extending in a generally transverse direction when said stock is unstressed, each individual carrier having two opposite edges, wherein the band segments defining each container-receiving aperture of each carrier include at least one cross segment joined integrally to two outer segments so as to define a generally Y-shaped junction, the cross segment so joined having a transverse midline dividing the cross segment so joined into two half segments, the cross segment so joined having a primary slit extending substantially along the transverse midline, at least one of the half segments of the cross segment so joined having a secondary slit parallel to the primary slit, the cross segment so joined having frangible bridges formed of the sheet material between the primary slit and an edge of the junction, between the respective slits, and between the secondary slit and such container-receiving aperture.

14. The carrier stock of claim 13 wherein the cross segment so joined has such a secondary slit parallel to the primary slit in each of the half segments.

15. The carrier stock of claim 13 wherein the cross segment so joined has a series of such secondary slits parallel to each other and to the primary slit in each of the half segments.

* * * * *